US007856915B1

(12) United States Patent
Anderson et al.

(10) Patent No.: US 7,856,915 B1
(45) Date of Patent: Dec. 28, 2010

(54) BLAST MITIGATING MOBILE SELF-CONTAINED NETWORKED CHECKPOINT

(75) Inventors: Steven E. Anderson, Fredericksburg, VA (US); Stephen J. Brannan, Ruther Glen, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 599 days.

(21) Appl. No.: 11/890,103

(22) Filed: Jul. 16, 2007

Related U.S. Application Data

(63) Continuation-in-part of application No. 11/801,769, filed on May 7, 2007, now Pat. No. 7,789,258.

(51) Int. Cl.
*F41H 7/00* (2006.01)

(52) U.S. Cl. ..... 89/36.07; 89/36.04; 89/920; 86/50; 220/1.5; 220/6

(58) Field of Classification Search ..... 89/36.04, 89/36.07; 86/50; 220/1.5, 6, 666
See application file for complete search history.

(56) References Cited

U.S. PATENT DOCUMENTS 4,248,342 A * 2/1981 King et al. ..... 206/3
4,574,523 A * 3/1986 Nasatka ..... 49/49
4,630,395 A * 12/1986 Nasatka ..... 49/49
5,274,356 A * 12/1993 Taricco ..... 340/515
5,613,453 A * 3/1997 Donovan ..... 110/237
6,112,931 A * 9/2000 Booth et al. ..... 220/88.1
6,341,708 B1 * 1/2002 Palley et al. ..... 220/1.5
6,354,181 B1 * 3/2002 Donovan ..... 86/50
6,587,790 B1 * 7/2003 Arnold ..... 701/213
6,862,847 B2 * 3/2005 Bigelow ..... 52/79.1
7,102,512 B2 9/2006 Pendergraft ..... 340/540
7,106,192 B2 9/2006 Johnson et al. ..... 340/540
7,159,503 B1 * 1/2007 Weatherwax ..... 89/36.04

(Continued)

OTHER PUBLICATIONS

M. Levinson, *The Box*, Princeton © 2006, pp. 134-137, 144-147, 262-263, 270-271.

*Primary Examiner*—Michael Carone
*Assistant Examiner*—Michael D David
(74) *Attorney, Agent, or Firm*—Gerhard W. Thielman, Esq

(57) ABSTRACT

A portable checkpoint system is disclosed that incorporates a configurable freight container to intercept and inspect an approaching vehicle. The container includes a quadrilateral set of walls connectable to form a rectangular box, first and second ends of the walls, a blast plate disposed within the box, and a receptacle for mounting a device. At least one of the ends includes a door. The blast plate is disposed between two interior surfaces of the quadrilateral set of walls for absorbing shock and shrapnel, such as at an oblique angle. The mounted device is an instrument for measuring a characteristic of the vehicle. Another such device is a lamp for illuminating the vehicle. The checkpoint includes an obstacle to direct the vehicle in traffic flow, and a pair of configurable freight containers as described. The obstacle directs the vehicle towards the zone. The containers are disposed substantially parallel to each other and separated apart to form a zone that enables the vehicle to pass there-between. The checkpoint includes a communications system accessible to a database having information on vehicle identification, vehicle sensory characteristics, personal identification and facial-recognition photographs for comparison with the vehicle and its occupants.

7 Claims, 10 Drawing Sheets

U.S. PATENT DOCUMENTS

| | | | | |
|---|---|---|---|---|
| 7,536,170 | B2 * | 5/2009 | Goldman et al. | 455/404.1 |
| 2007/0012168 | A1 * | 1/2007 | Weatherwax | 89/36.04 |
| 2007/0234892 | A1 * | 10/2007 | Goldman et al. | 89/1.13 |
| 2008/0134868 | A1 * | 6/2008 | Goldman et al. | 89/1.13 |
| 2008/0134869 | A1 * | 6/2008 | Goldman et al. | 89/1.13 |
| 2008/0134871 | A1 * | 6/2008 | Goldman et al. | 89/1.13 |
| 2008/0134872 | A1 * | 6/2008 | Goldman et al. | 89/1.13 |
| 2008/0266165 | A1 * | 10/2008 | Daly et al. | 342/22 |
| 2010/0043629 | A1 * | 2/2010 | Carberry et al. | 89/36.02 |

* cited by examiner

BLAST MITIGATING MOBILE SELF-CONTAINED NETWORKED CHECKPOINT

CROSS REFERENCE TO RELATED APPLICATION

The invention is a Continuation-in-Part, claims priority to and incorporates by reference in its entirety U.S. patent application Ser. No. 11/801,769 filed May 7, 2007 titled "Mobile, Self-Contained and Networked Checkpoint" to Steven E. Anderson and assigned Navy Case 98342.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to a portable system for establishing a temporary roadway checkpoint for investigating entry and egress therethrough, with communication linkage to verification databases. More particularly, the invention relates to a system of sensor-equipped portals through which a vehicle passes while being inspected, each portal being foldable into a shipping container configuration.

The frequency of terrorist incidents that employ an improvised explosive device (IED) has increased dramatically since 1998, according to the Memorial Institute for the Prevention of Terrorism at http://www.tkb.org/Home.jsp. Mitigating this threat to life and property necessitates improved inspection of road-mobile vehicles that harbor such IEDs, as well as their occupants who clandestinely deploy them.

Unscheduled investigation of a vehicle traveling along a road typically necessitates tradeoffs that exacerbate the ability to intercept and mitigate against nefarious activities injurious to civil society, e.g., transport of contraband, deployment of improvised explosive devices, escape of individuals sought for custody, etc.

A roadblock checkpoint may entail risk to personnel for investigating a detained vehicle. Such an impromptu arrangement may locally lack information resources to identify any occupants or verify the vehicle's status. Moreover, the time devoted to such investigation may be curtailed to mitigate traffic impedance, resulting in reduced interception of intended targets. Static checkpoints for fixed installations with a more complete range of investigative tools may not be suitable for evasive targets.

Currently, modular checkpoints have been established to provide stations for screening individual persons seeking to enter a controlled area, such as an airport terminal. Such art includes U.S. Pat. Nos. 7,106,192 to Johnson et al. and 7,102,512 to Pendergraft.

SUMMARY

Conventional checkpoint arrangements yield disadvantages addressed by various exemplary embodiments of the present invention. In particular, the conventional systems lack a convenient ability to provide comprehensive sensory information on a vehicle at relocatable positions.

Various exemplary embodiments provide a portable checkpoint system that incorporates a configurable freight container. A portable checkpoint system is disclosed that incorporates a configurable freight container to intercept and inspect an approaching vehicle. The container includes a quadrilateral set of walls connectable to form a rectangular box, first and second ends of the walls, a blast plate disposed within the box, and a receptacle for mounting a device. At least one of the ends includes a door. The blast plate is disposed between two interior surfaces of the quadrilateral set of walls for absorbing shock and shrapnel, such as at an oblique angle. The mounted device is an instrument for measuring a characteristic of the vehicle. Another such device is a lamp for illuminating the vehicle.

In various exemplary embodiments, the checkpoint includes an obstacle to direct the vehicle in traffic flow, and a pair of configurable freight containers as described. The obstacle directs the vehicle towards the zone. The containers are disposed substantially parallel to each other and separated apart to form a zone that enables the vehicle to pass therebetween. In other embodiments, the checkpoint includes a communications system accessible to a database having information on vehicle identification, vehicle sensory characteristics, personal identification and facial-recognition photographs for comparison with the vehicle and its occupants.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention.

Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The portable system to provide vehicle checkpoints, for various exemplary embodiments, employs at least one freight container. The system preferably uses the 40-ft (12.2 m) version for cargo shipping as well as rail transport, also known as the "forty-foot equivalent unit" (FEU). The 40-ft container has interior dimensions of length 39 ft ⅜ in, width 7 ft 8⅜ in, and height 7 ft 9⅝ in for a total volume of 2,376 $ft^3$.

An alternative is the 20-ft (6 m) version, also known as the "twenty-foot equivalent unit" (TEU). Thus, an FEU is equivalent to two TEUs. Other standard lengths include 45-ft (13.7 m), 48-ft (14.6 m) and 53-ft (16.2 m). These freight containers comply with ISO (International Standards Organization) requirements. The maximum gross mass for a 20-ft dry cargo container is 24,000 kg, and for a 40-ft is 30,480 kg yielding respective payload masses (gross minus tare) of about 21,600 kg and 26,500 kg.

The FEU and TEU freight container sizes developed over the 1960s through the United States Marine Administration and the ISO during the automization of the cargo transportation industry from breakbulk to containerized freight. Description of this process can be found in *The Box: How the Shipping Container Made the World Smaller and the World Economy Bigger* by Marc Levinson, Princeton, ©2006, pp. 134-137 and 144-146. The container's introduction reduced freight rates from Asia to North America by an estimated forty to sixty percent (*The Box*, p. 263). With the lowering of transportation costs, the volume of sea freight quadrupled as with, for example, Hamburg, Germany, which increased from handling eleven million tons of cargo in 1960 to over forty million tons in 1996, eighty-eight percent in containers (*The Box*, p. 271).

Figure 1:
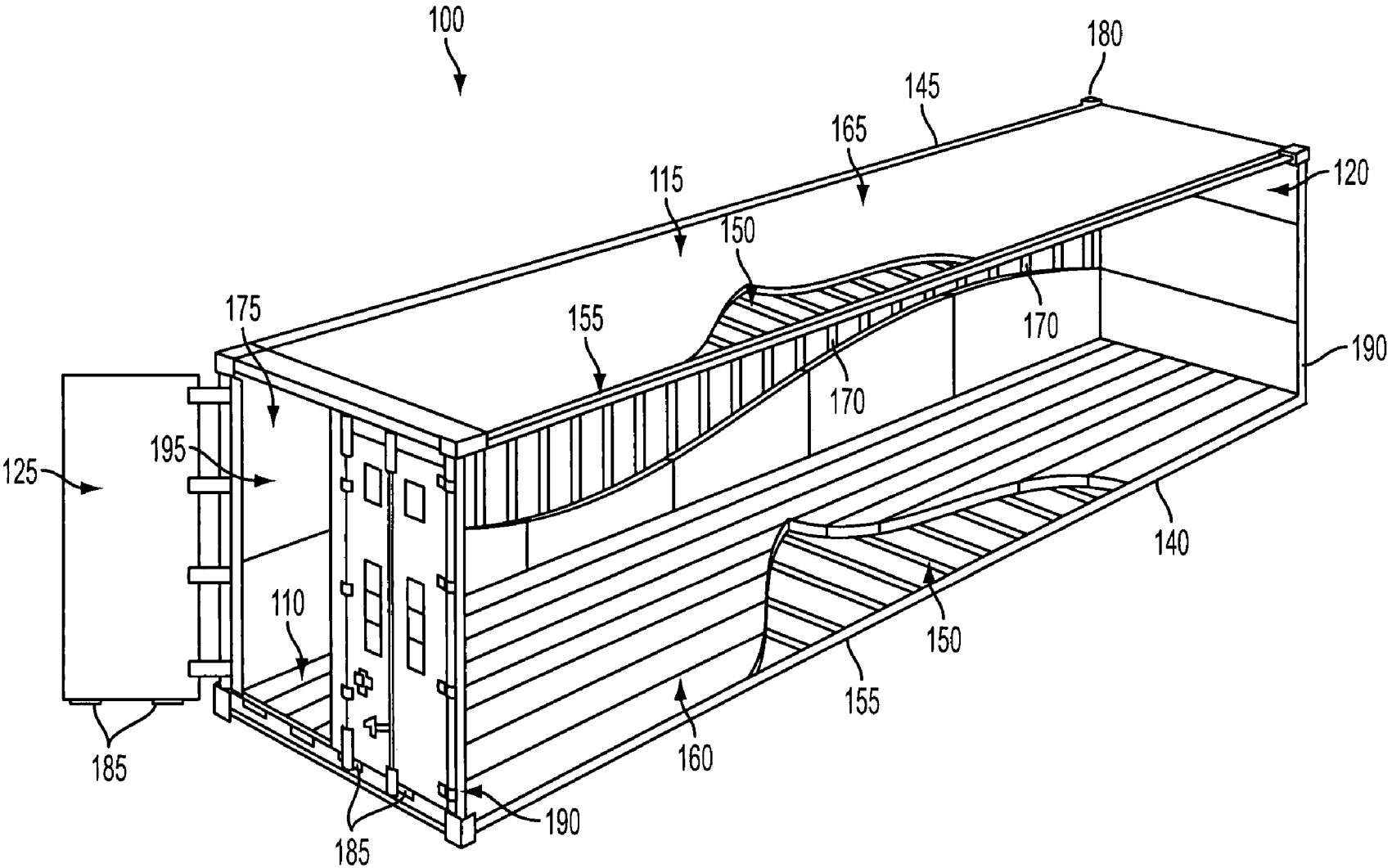
FIG. 1 is a perspective view of a modified freight container in stowed configuration.

Deployable Embodiment: FIG. 1 shows an isometric view of an exemplified embodiment of an FEU freight container 100 in folded and stowed configuration for transportability. Upon delivery to an installation site, the container 100 may be disposed with a bottom floor 110 on the ground opposite a top ceiling 115 and subsequently unfolded for checkpoint deployment.

The container 100 includes front and rear ends, with the front end 120 being closed or alternatively having doors, and the aft end having doors 125 that may be opened and secured to their respective left and right side walls 130, 135. (The front and rear ends merely represent an orientation convention, which is not intended to be limiting.) Alternatively, the doors 125 may be removed and installed as ramps for vehicle approach and departure. The floor 110, left wall 130, ceiling 115 and right wall 135 may be connected along their edges to form a rectangular box, which can be closed by securing the doors 125.

A longitudinal hinge 140 (shown along the lower starboard edge) enables the container 100 to separate at an opposite lockable joint or latch 145 (shown along the upper port edge). The right side wall 135 may swing down to the ground, substantially parallel to the bottom floor 110, while the top ceiling 115 forms a deployed starboard barrier. The left side wall 130 forms the deployed port barrier, substantially parallel to the ceiling 115 as deployed.

Thus, the hinge 140 rotatably connects two joined adjacent walls (floor 110 and right side 135) of the container 100 along a first common edge, and the latch 145 connects the opposite adjacent walls (ceiling 115 and left side 130) along a second common edge opposite the first. The hinge 140 at the first common edge may swing from an orthogonal closed position to a coplanar open position. Similarly, the latch 145 at the second common edge may remain integral at the closed position and separated at the open position.

The closed position maintains the two joined adjacent walls mutually perpendicular to each other and the opposite walls together, also mutually perpendicular. The open position disposes the joined adjacent walls to be parallel and alongside each other, as well as the opposite walls to be separate and facing each other from opposing ends of the coplanar walls.

Cutaway portions illustrate interior structures of the floor 110, ceiling 115, left side wall 130 and right side wall 135. The floor 110 and ceiling 115 include cross-members 150 extending substantially perpendicular from edge rails 155 (e.g., including the hinge 140) and sandwiched between interior boards 160 and exterior panels 165.

The side walls 130, 135 include posts 170 disposed in corrugated fashion outside of interior panels 175 as corrugation structural support and substantially parallel to the cross-members 150. The corners 180 between the headers may be reinforced for increased structural integrity. The doors 125 may be locked by locking bars or latches 185 and hinged to support frames 190. The boundaries of the container 100 enclose a cargo space 195 having a standard volume defined based on length and height.

Figure 2B:
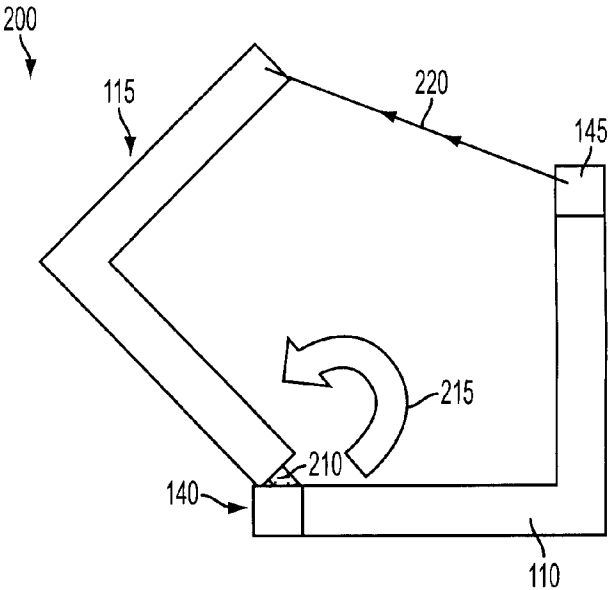
FIGS. 2A, 2B and 2C are elevation views of the container in stowed, deploying and deployed configurations, respectively.
Figure 2C:
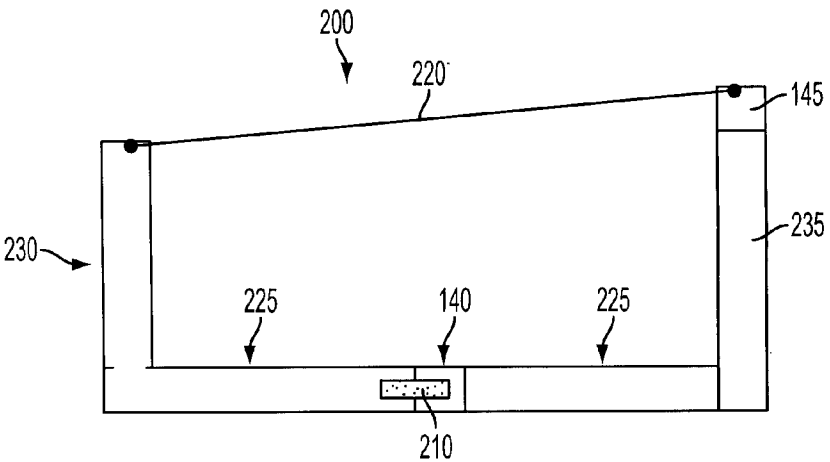
Figure 2A:
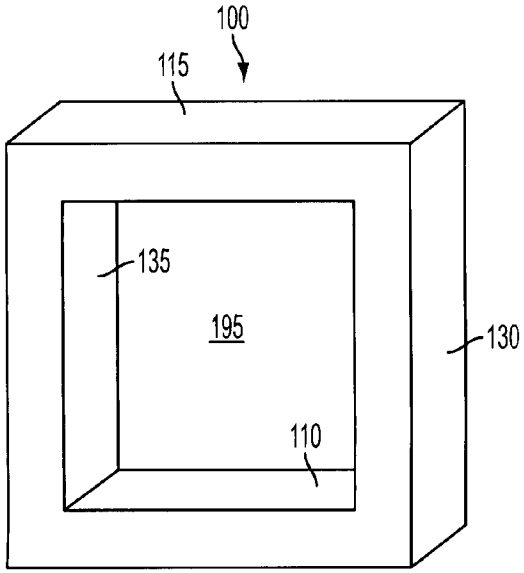

FIGS. 2A, 2B and 2C illustrate elevation views of the container as observed from the forward (front) end looking towards the aft (rear) end. FIG. 2A shows the container 100 as stowed with the latch 145 closed and locked. FIG. 2B shows, in deployment configuration, the container as a channel 200 unfolding with the hinge 140 extending and pivoting to rotate the right side wall 135 toward the ground. FIG. 2C shows, after deployment, the container as a channel 200 having been unfolded with the latch 145 open and right side wall 135 parallel to the floor 110.

The hinge 140 may include an hydraulic actuator 210 to enable the right wall 135 to pivot relative to the floor 110 without interference. The rotation is shown in the direction of the angling arrow 215. As the latch 145 unlocks, cables 220 may extend between a left edge on the left side wall 130 and a right edge on the ceiling 115 to facilitate control during deployment, thereby avoiding sudden descent of the right side wall 135 with possible risk of injury for crew. Upon deployment as shown in FIG. 2C, the channel 200 includes a drive platform 225 flanked by a port barrier 230 and a starboard barrier 235.

Figure 3A:
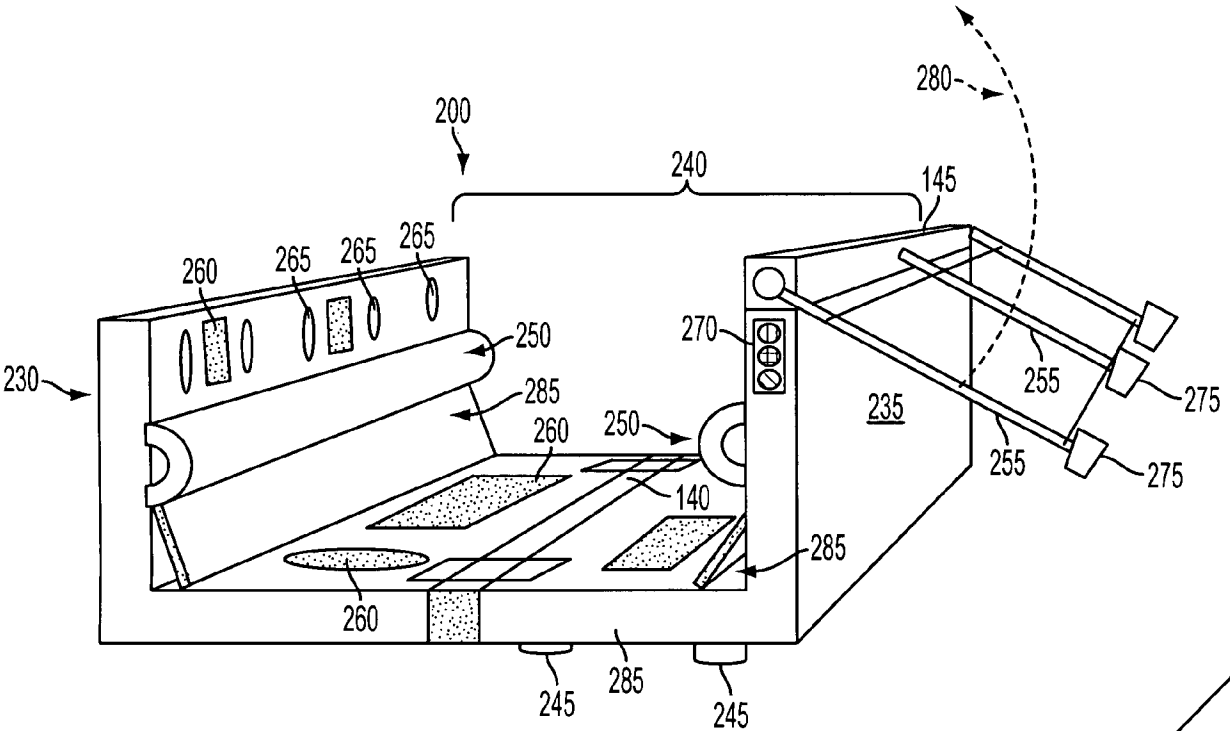
FIG. 3A is a perspective view of the container in deployed configuration as a channel.

FIG. 3A shows an isometric view of the deployed channel 200 as observed from the aft end looking toward the forward end. The floor 110 and the right side wall 135, parallel and in tandem, form the deployed drive platform 225. Thus, the left side wall 130 in the stowed configuration represents the deployed port barrier 230, whereas the ceiling 115 forms the deployed starboard barrier 235. The substantially parallel barriers 230, 235 define an inspection or surveillance zone 240 in which a vehicle therethrough can be investigated and/or detained as a further security procedure.

The underside of the drive platform 225 (from either the floor 110 and/or the right side wall 135) may include conformable pads 245 that extend from the outer surfaces thereby enabling the channel 200 to be disposed level to the ground. These pads 245 may be independently or automatically controlled to provide self-leveling capability. Otherwise, local variations in ground topology, such as obstructions or cavities from natural or artificial causes may produce unevenly distributed loading. Such conditions could adversely influence instrumentation and/or buckle the deployed channel 200, thereby inhibiting stowage reconfiguration.

Deformably elastic rails or bumpers 250 may protrude into the zone 240 to inhibit a vehicle from inadvertent contact with the barriers 230, 235. The bumpers 250 may be intermittently distributed over portions of the barriers 230, 235 or alternatively extend over their entire lengths. Lightweight anti-personnel barriers 255 may pivotably overhang from the tops of the barriers 230, 235 to inhibit unauthorized intruders from invading the zone 240. As shown, the barriers 255 are mounted on hinges to the latch 145.

A variety of embedded sensors 260 and recessed light sources or lamps 265 may be disposed along the interior surfaces of the drive platform 225 and the barriers 230, 235. These sensors 260 may include instruments to measure or detect, for example, chemical and/or physical responses to particular contraband, such as conventional explosives, narcotics, materials for such synthesis, etc.

Additionally or alternatively, the sensors 260 may include video-graphic instruments to distinguish and/or record optical and audio signatures of the transiting vehicle's exterior and interior features. Photometric sensors for optical measurements may, for example, be sensitive to the ultraviolet, visible, infrared, microwave and/or radio electromagnetic spectrums. The light sources 265 may provide illumination for the zone 240, particularly for nighttime operations.

A traffic signal 270 may be disposed at or adjacent to one or both of the barriers 230, 235. The traffic signal 270 may be positioned at the aft end of the channel 200, as shown for approach instruction, and/or towards the forward end (for departure instruction) to control entrance and egress of vehicles for inspection.

Additional illumination in the zone 240 can be provided by equipping ends of the anti-personnel barrier 255 with floodlights 275 and rotating the barrier 255 across the starboard barrier 235 by the indicated angle 280. Protection from explosion for the personnel at the checkpoint can be provided by blast deflector plates 285 to obliquely reflect the pressure wave and shrapnel, thereby redirecting the destructive energy away from its intended target. The deflector plates 285 may but need not be flat. Preferably the deflector plates 285 may be composed of sheet metal, e.g., steel, having a thickness of at least one-half-inch.

Figure 3B:
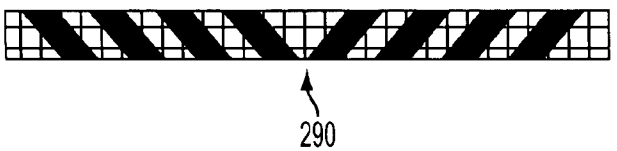
FIG. 3B is an elevation view of a visual indicator for the bumper.
Figure 3C:
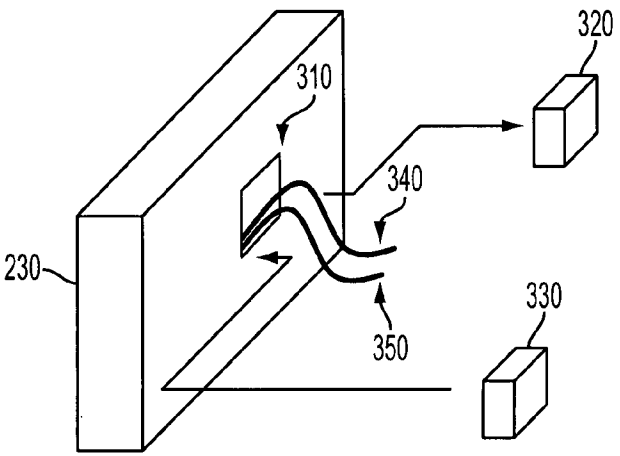
FIG. 3C is a perspective view of interchangeable sensors.

FIGS. 3B and 3C illustrate details within the zone 240. FIG. 3B shows an elevation view of a visual warning indicator 290 that may be disposed on the bumpers 250. The design provided represents an example with black slanting stripes superimposed over a yellow strip field. FIG. 3C shows the flexibility of replacing one sensor type with another for the sensor 260 within the barriers 230, 235. A reconfigurable sensor platform 300 includes a mounting station or receptacle, as provided by a cavity 310 from which a first sensor 320 may be removed and replaced by a second sensor 330. For sensors 260 that require power and/or communication interface, coupling cables having standard ports or plugs may be provided, such as the power cable 340 and the interface cable 350.

Figure 4A:
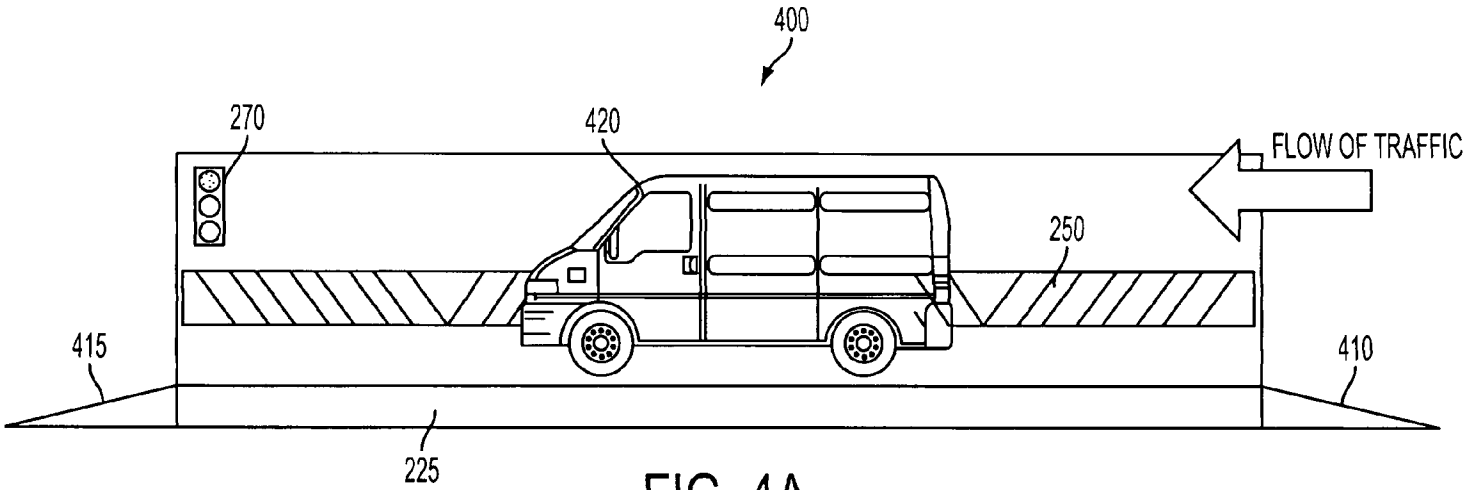
FIGS. 4A and 4B are section views of the channel in single and double-length configurations.
Figure 4B:
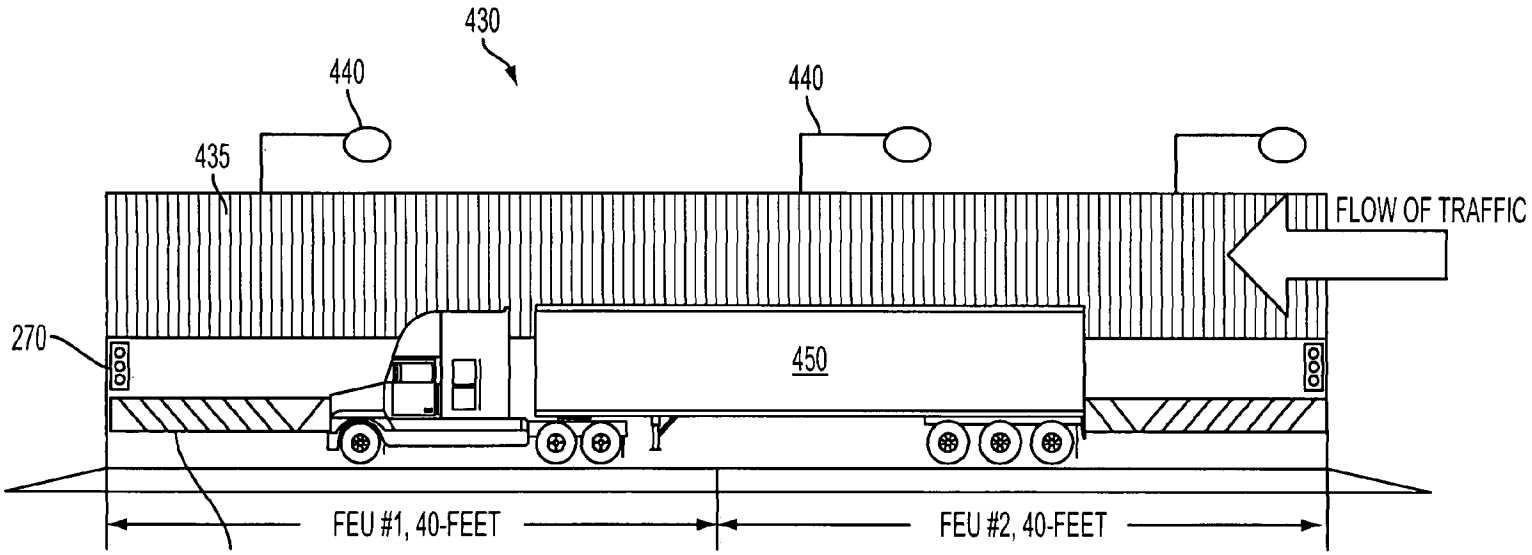

FIGS. 4A and 4B illustrate section (side-elevation) views of the channel 200 as observed from the port side with the port barrier 230 removed for clarity. FIG. 4A shows a single channel 400 having an aft entrance ramp 410 and a front exit ramp 415 disposed between the drive platform 225.

The entrance and exit ramps 410, 415 may be converted from the container doors 125, 120. The bumpers 250 may include slanted stripes or other appropriate markings to denote direction or visually draw attention to them for contact avoidance.

A single vehicle (a minivan) 420, enters the inspection zone 240 and travels along the drive platform 225. The traffic signal 270 indicates to the vehicle's driver when to depart, passing along the drive platform 225 onto the exit ramp 415 and clear the zone 240, thereby enabling the single channel 400 to receive another vehicle and direct traffic in the direction of arrow 425.

FIG. 4B shows dual channels 200 concatenated together as a double FEU-length configuration 430, with the entrance ramp 410 at an aft end and the exit ramp 415 at the forward end of the combination. The double configuration 430 may include elevated extension panels 435 with retractable booms 440 that contain sensors and/or light sources. Such an arrangement may be intended for convoys and/or extended vehicles, such as a semi-tractor-trailer truck 350 as shown. The bumpers 250 (shown with the striped warning indicator 290) and traffic signals 270 may provide ancillary instructions to the truck's driver.

Figure 5:
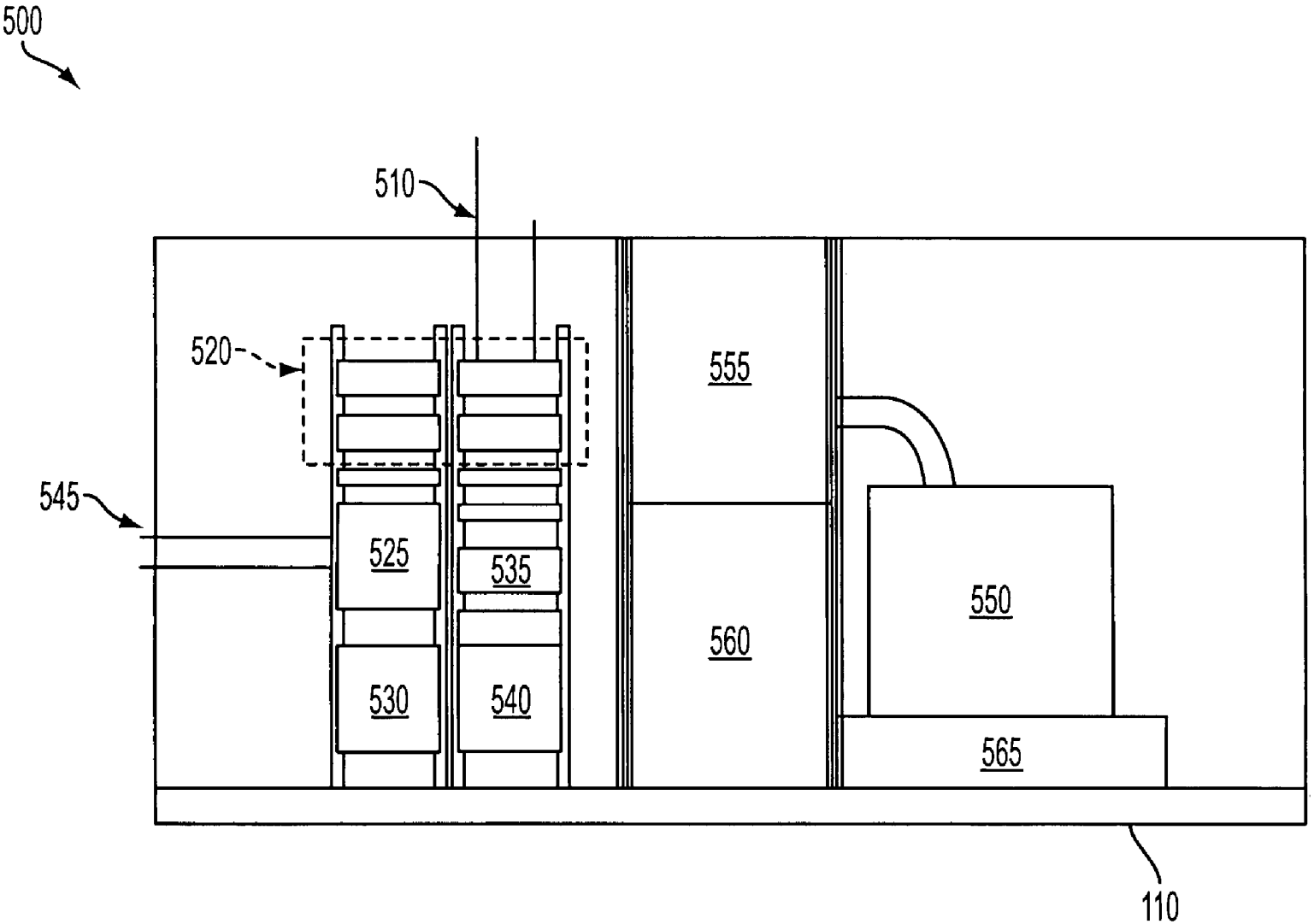
FIG. 5 is an analogous section view of a support bay.

A checkpoint may include, in addition to the instrumented channel 200, a support bay with auxiliary equipment. FIG. 5 shows an elevation view of the support bay 500 having mounts for antennas 510 and racks 515 for various equipment 520. The support bay 500 may be separately portable from the channel 200, such as in a separate freight container (e.g., a TEU equivalent), or stored within the stowed container 100 within the cargo space 195.

The antennas 510 may be designed for radios, satellite communications, cell phones, et. The equipment 520 for the support bay 500 may be deployed to be installed on the racks 510 disposed alongside the barriers 230, 235. This equipment 520 may include computation, memory and communication components, such as a server 525, a central processing unit (CPU) 530, a redundant array of independent disks (RAID) 535 and a Global Positioning System (GPS) receiver 540. The server 525 may be connected to a local or wide network by connection lines 545 (e.g., fiber optics, cables, twisted pair leads).

Electrical power may be independently supplied by a multi-kilowatt diesel power generator 550 and controlled by an automated power management conditioner 555. Fuel (e.g., diesel oil) for the generator may be stored in a 500-gallon storage tank 560 (as shown on the container floor 110).

Additionally, a hazardous material (HAZMAT) storage bin 565 may be used to provisionally collect chemically or radioactively contaminated items until final removal and disposal. The power conditioner 555 and the fuel tank 560 may be externally accessible for maintenance and refueling beyond the inspection zone 240. The equipment 520 may include shock and vibration absorption mechanisms (e.g., spring-mounts on the racks), as well as noise mitigation dampeners.

Figure 6:
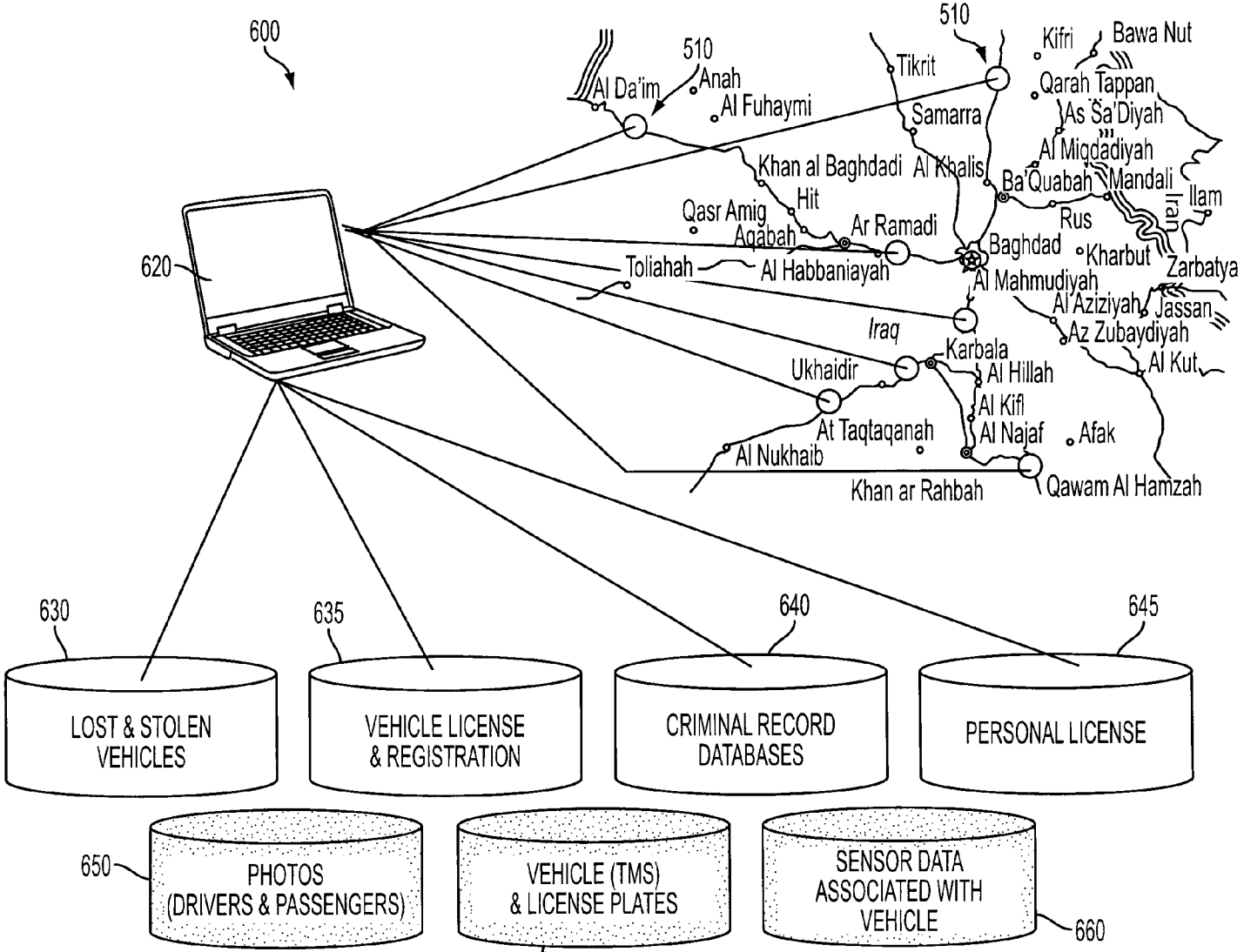
FIG. 6 is a network diagram view of a linked communication and database system.

Each portable checkpoint deployed as the channel 200 may communicate with other checkpoints or with a coordination center having access to one or more databases consulted for investigations. FIG. 6 depicts a network constellation 600 connecting communication nodes 610 to a nexus depicted as a laptop computer 620. Each node may correspond to a checkpoint (whether permanent or relocatable) located within or near a geographical urban site, such as shown for an example region in the Middle-East.

The computer 620 may be in contact with a variety of databases with which to compare information regarding the vehicles 420, 450, or their occupants. Such databases may include vehicle records as lost or stolen vehicles 630, and vehicle registration and licensing 635, personal records for pedestrians or vehicle occupants, such as criminal records 640, and personal identification 645 (e.g., driver's license, passport). The databases may also or alternatively include non-tabular information, such as digitally-recorded facial-recognition photographs 650, vehicle license plates 655 and vehicle sensor data 560.

The CPU 530 may be incorporated as part of or otherwise associated with the computer 620. The server 525 may provide connection to the databases 630, 635, 640, 645, 650, 655, 660. The CPU 530 may perform comparisons between the data received from the sensors 260 and information in these databases. In addition, the CPU 530, in conjunction with the GPS receiver 540, may provide information or instructions, to other nodes 610 for coordination of operations to address against an indicated threat.

Figure 7:
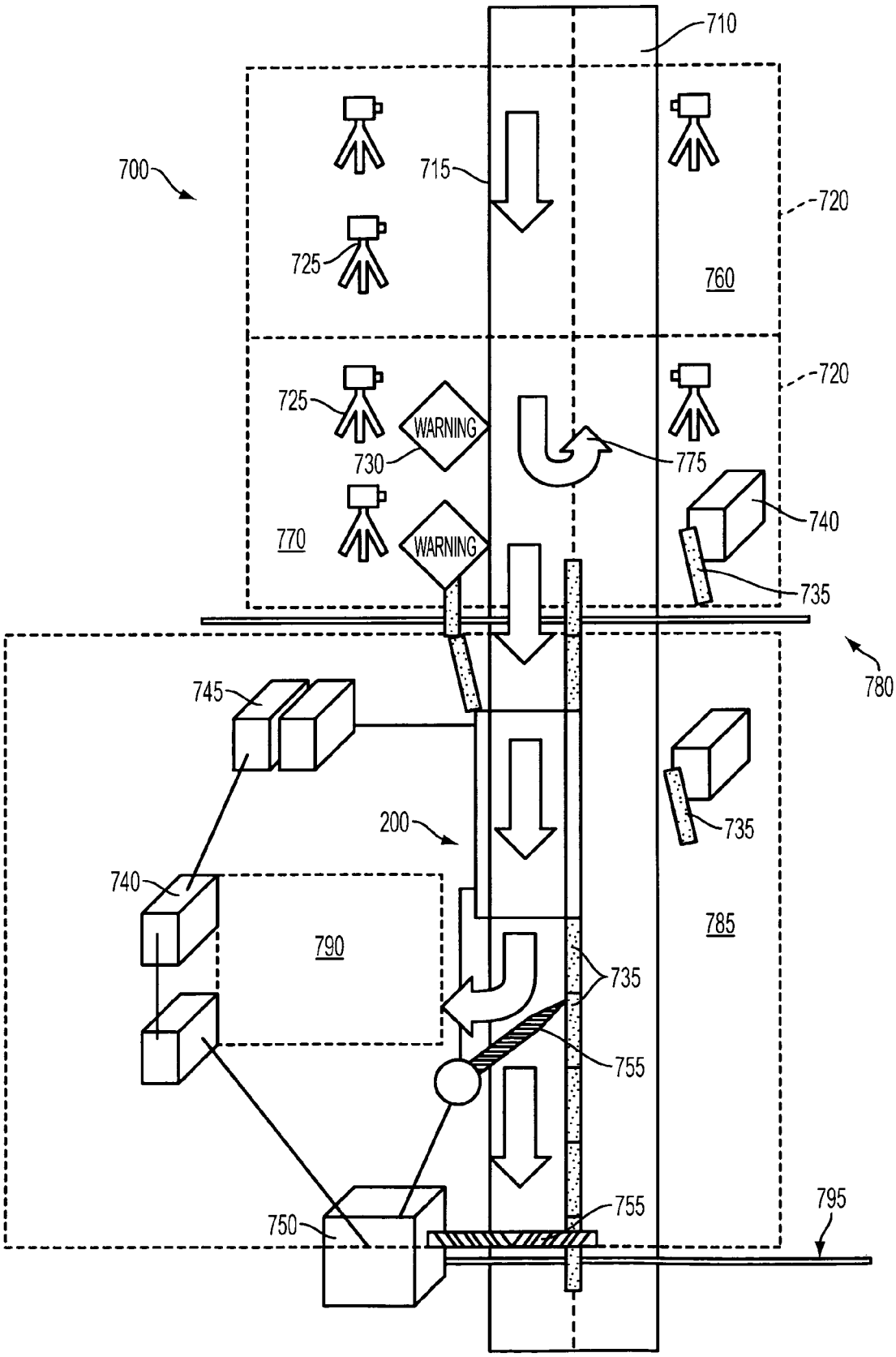
FIG. 7 is a plan view of single-lane checkpoint.

The checkpoint may include several components integrated together to investigate a vehicle traveling along a road. FIG. 7 shows a plan view of a checkpoint 700 for one direction on a two-lane bi-directional road 710, with vehicles to be intercepted traveling in the direction indicated by arrow 715. The checkpoint 700 may include netted sensor grids 720, strategically positioned cameras 725, instruction signs 730, concrete barricades (e.g., obstacles) or jersey walls 735, containment buildings 740, trailers 745, a guard shelter 750 and gates 755. The grids 720 may optionally be stowed in the space 195 of the container 100 while in transport prior to being unfurled. Similarly, the cameras 725 and signs 730 may also be stowed in the space 195.

The grids 720 may engage in surveillance of vehicles traveling in the direction indicated by arrow 715. The instruction signs 730 may provide information to alert drivers to reduced speed and preparation to stop. The jersey walls 735 provide portable obstacles against traffic deviation. The containment buildings 740 may be used for maintaining personnel or detaining custodials. The trailers 745 may be for housing network and power equipment. The guard shelter 750 and gates 755 may be used to control through-traffic.

The checkpoint 700 may be divided into sections. The first section represents a surveillance and monitoring zone 760 having the grid 720 and the cameras 725. The second section represents a commitment zone 770 within which a vehicle may turn around indicated by curved arrow 775. The vehicle reaches a line-of-no-return 780 upon reaching the earliest jersey wall 735, after which the vehicle enters a checkpoint operations zone 785 to approach and enter the channel 200. At this stage, the checkpoint personnel may have options flexible response in depth regarding the approaching vehicle, depending on the level of apparent or perceived risk.

After completion of sensory investigation within the channel 200, the vehicle may be directed by the gates 755 to a detainment (or detention) area 790 for incarceration and/or interrogation of vehicle occupants and possible vehicle impoundment. Otherwise, the vehicle may be permitted to pass through after investigation and proceed past the guard shelter 750 and beyond the line of passage 795.

Figure 8:
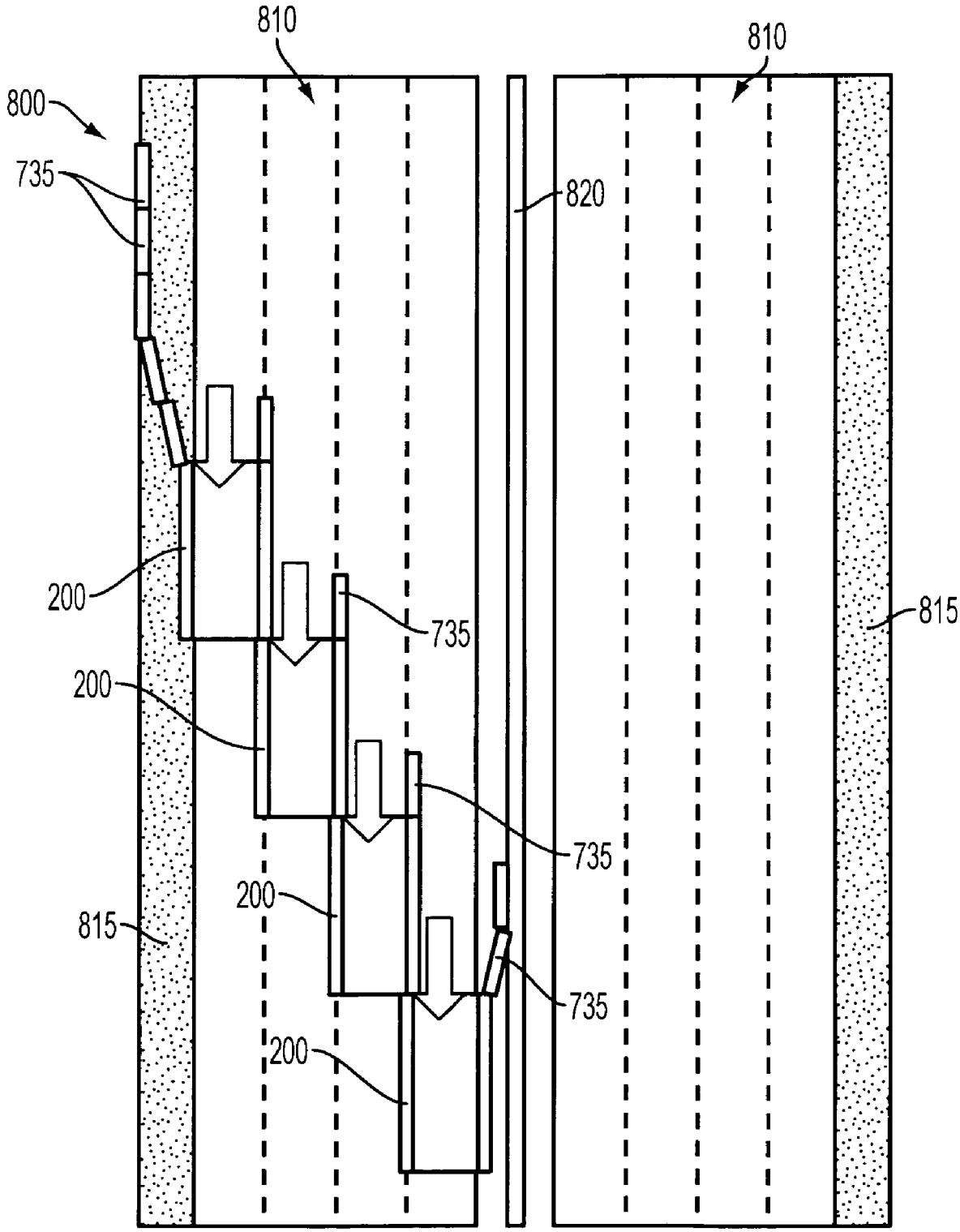
FIG. 8 is a plan view of a multilane checkpoint.

FIG. 8 shows a plan view of a checkpoint 800 for one direction on a single-direction side of an eight-lane divided bi-directional highway 810 with shoulders 815 and a divider 820 separating the two directions. Jersey walls 735 may be disposed along the approach to each of the channels 200 in staggered arrangement, one for each lane.

Under these conditions, a portable checkpoint can be established by transporting one or more freight containers 100 to an intended destination site, such as along an otherwise non-blockaded road 710. Upon delivery to the temporary checkpoint destination, the container 100 may be deployed to form an instrumented channel 200. Auxiliary equipment and barriers may be tactically disposed at the site to direct traffic as individual vehicles 420 into the channel 200 for preliminary inspection.

Depending on verification of innocuous nature or else indication of threat possibility, the vehicle 420 may be authorized to proceed or be further detained for more thorough investigation. Upon completion of the mission objectives, the equipment may be recovered and the channel 200 be folded into the stowed container 100 again.

Figure 9:
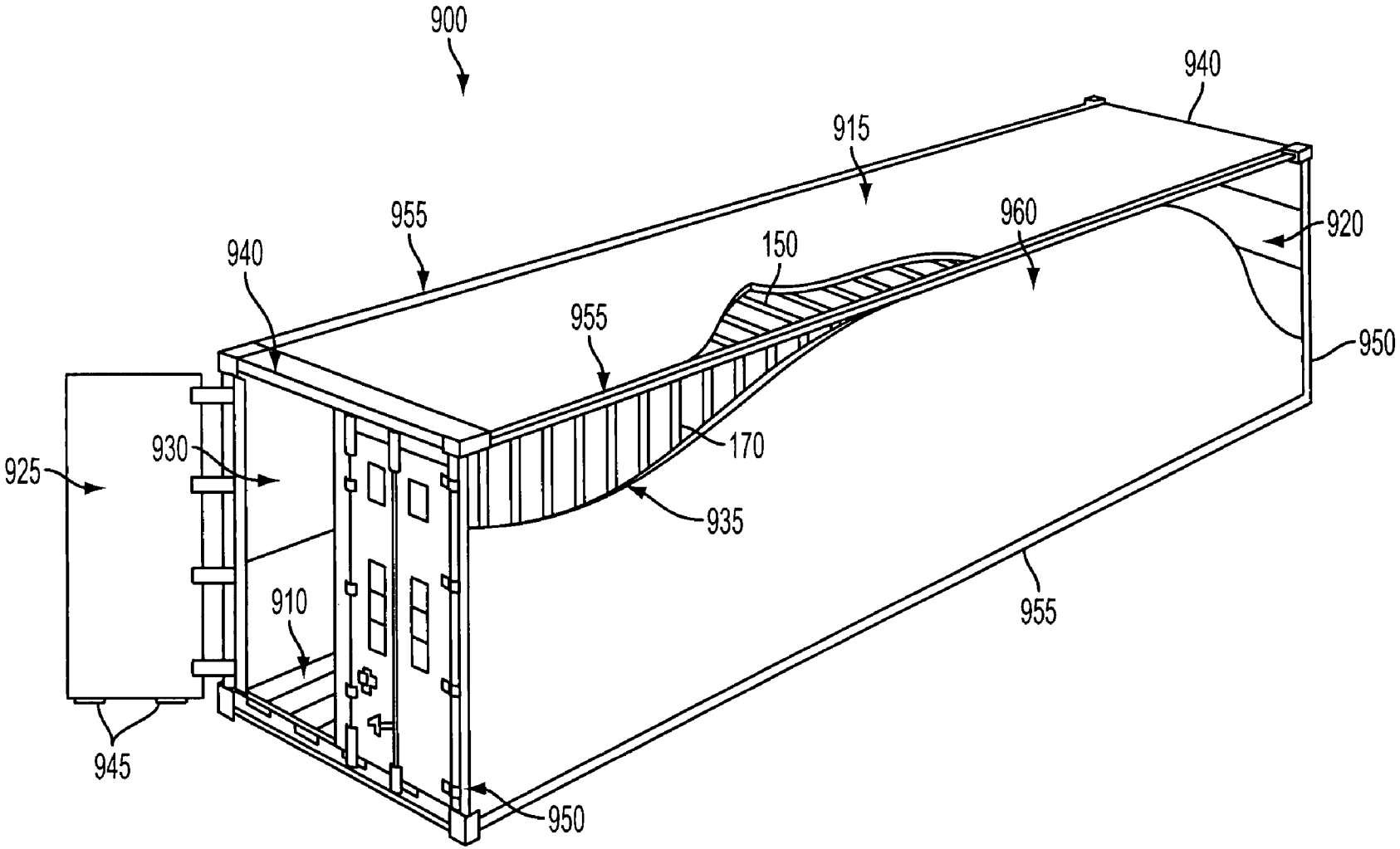
FIG. 9 is a perspective view of an integral freight container.

Integral Embodiment: FIG. 9 shows an isometric view of an exemplified embodiment of an FEU freight container 900 in integral configuration. Upon delivery to an installation site, the container 900 may be disposed with a bottom floor 910 on the ground opposite a top ceiling 915.

The container 900 includes front and rear ends, with the front end 920 being closed or alternatively having doors, and the aft end having doors 925 that may be opened and secured to their respective port and starboard side walls 930, 935. (The front and rear ends merely represent an orientation convention, which is not intended to be limiting.)

The floor 910, port wall 930, ceiling 915 and starboard wall 935 may be connected along their edges to form a rectangular box, which can be closed by securing the doors 925. The rectangular box is integrally retained in this configuration without any hinge or latch. The advantageous differences of the integral container 900 from the hinged container 100 include elimination of alteration processes (e.g., cutting, welding) to retrofit separation and reconnection elements (i.e., hinge, latch, etc.).

The front end 920 and the rear end maintaining the rear doors 925 may be structurally maintained with horizontal frames 940 (including mechanisms to facilitate loading and unloading of the container). The doors 925 may be secured to the frame 940 by locking bars 945. The frames 940 are connected by vertical posts 950. The front and rear ends are connected by rails 955 that provide the edges to secure the walls to the floor and ceiling. The frames 940, posts 950 and rails 955 are substantially perpendicular to each other.

The starboard wall 935 is shown substantially in cutaway to display a blast plate 960, which may be sized to lean against one side, shown as the port wall 930, and secured by the edge between the floor 910 and the starboard wall 935. Alternatively, the blast plate 960 may be welded into position or permanently mounted in an alternative fashion.

The blast plate 960 provides protection for personnel analogous to the blast plate 285 for the deployable configuration. In the integral configuration, the blast plate may be transported with the container 900 to facilitate deployment. The blast plate 960 may but need not be flat. Preferably the blast plate 960 may be composed of sheet metal, e.g., steel, having a thickness of at least one-half-inch. Such material is readily available and comparatively inexpensive. Nonetheless, the blast plate 960 may be composed of alternative materials and configurations to provide protection from an active threat.

The container 900 may be disposed adjacent to a road or entry to enable a vehicle 420 to pass alongside for investigation. The exterior surfaces of the container 900 may include sensors 260 and/or lamps 265, as desired. Operational equipment 520 for computation, memory and communication may be housed and/or mounted inside the container 900.

Figure 10:
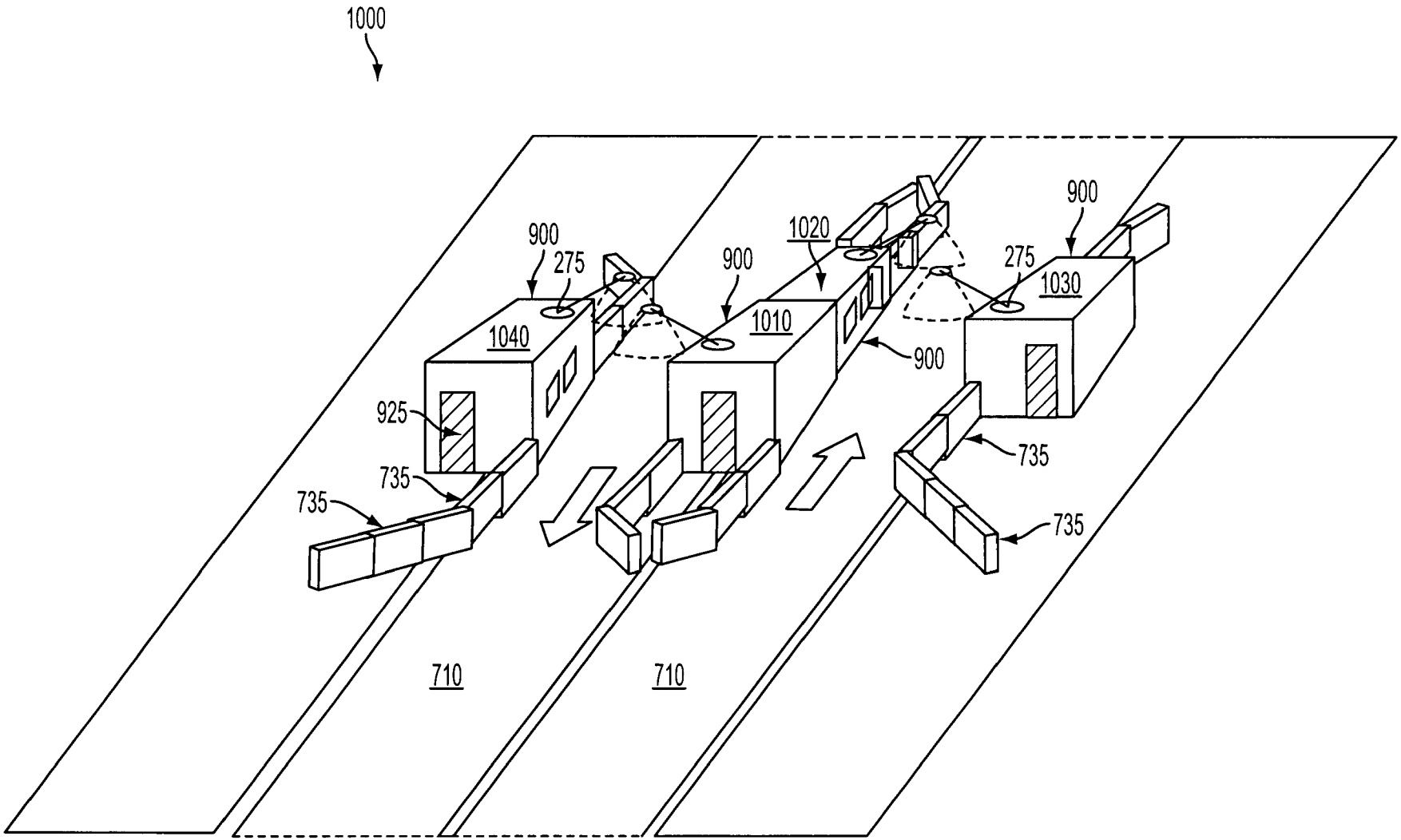
FIG. 10 is a perspective view of a bi-directional checkpoint.

FIG. 10 illustrates a perspective view of a bi-directional checkpoint 1000. Several integral containers 900 may be employed for this purpose. A pair of concatenated transmitter boxes 1010, 1020 may be disposed in tandem along the division of the opposing lanes 710. A first receiver 1030 may be disposed along the right lane shoulder, and a second receiver 1040 may be disposed along the left lane shoulder to investigate traffic traveling opposite the right lane shoulder.

The transmitter boxes 1010, 1020 may interrogate an adjacent vehicle with electromagnetic radiation (e.g., radar) while the receives 1030, 1040 may receive scattered radiation reflected or diffused by the vehicle. In addition, booms 440 mounted on the containers 900 may provide flood-light illumination from lamps 265 or alternatively additional sensors 260, such as a camera. Jersey barriers 735 may be disposed fore and aft of the containers 900 to direct traffic therebetween.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A portable configurable checkpoint to intercept and inspect an approaching vehicle, comprising: an obstacle to direct the vehicle in traffic flow; and a pair of configurable freight containers that each includes: a quadrilateral set of walls connectable to form a rectangular box; first and second ends of the walls, at least one of the ends having a door; a blast plate disposed between two interior surfaces of the quadrilateral set of walls for absorbing shock and shrapnel; wherein the blast plate is disposed with a first edge leaning against a first interior side wall and a second edge opposite the first edge disposed against at least one of a floor and a second interior side wall opposite to the first interior side wall; and a receptacle for mounting at least one of an instrument for measuring a characteristic of the vehicle and a lamp for illuminating the vehicle, wherein the containers are disposed substantially parallel to each other and separated apart to form a zone that enables the vehicle to pass there-between, and the obstacle directs the vehicle towards the zone.

2. The checkpoint according to claim 1, wherein the first container of the pair is a transmitter of electromagnetic energy and the second container of the pair is a receiver.

3. The checkpoint according to claim 1, further comprising:

a communications system accessible to a database, wherein the database includes information on at least one of vehicle identification, vehicle sensory characteristics, personal identification and facial-recognition photographs for comparison with the vehicle and the occupants therein.

4. The checkpoint according to claim 1, wherein the communication system is accessible to another checkpoint at a separate location.

5. The checkpoint according to claim 1, wherein the second edge is disposed at an intersection between the second interior side wall and the floor.

6. The container according to claim 1, wherein the blast plate is substantially flat and disposed at an oblique angle relative to the floor and to the interior side walls.

7. The container according to claim 1, wherein the blast plate is composed of sheet metal.

* * * * *